US005097570A

United States Patent [19]

Gershenson

[11] Patent Number: 5,097,570

[45] Date of Patent: Mar. 24, 1992

[54] FASTENING SYSTEM

[76] Inventor: Bruce Gershenson, 26645 Irving, Franklin, Mich. 48025

[21] Appl. No.: 645,453

[22] Filed: Jan. 23, 1991

[51] Int. Cl.[5] ..... A44B 17/00

[52] U.S. Cl. ..... 24/452; 24/442

[58] Field of Search ..... 24/452, 442, 306, 444, 24/449, 450, 587, 576, 400, 391, 394; 383/63, 65

[56] References Cited

U.S. PATENT DOCUMENTS

| | | | |
|---|---|---|---|
| 2,018,099 | 10/1935 | Sundback | 24/391 |
| 2,878,541 | 3/1959 | Hansen | 24/391 |
| 3,266,113 | 8/1966 | Flanagan, Jr. | 24/452 |
| 3,808,648 | 5/1974 | Billarant et al. | 24/442 |
| 3,849,840 | 11/1974 | Yamada et al. | 24/450 |
| 4,946,527 | 8/1990 | Battrell | 24/444 |

FOREIGN PATENT DOCUMENTS

| | | | |
|---|---|---|---|
| 1313692 | 11/1962 | France | 24/576 |

*Primary Examiner*—Victor N. Sakran

*Attorney, Agent, or Firm*—Weintraub, DuRoss & Brady

[57] ABSTRACT

A fastening system for fastening devices using manual pressure includes at least two flexible opposed fastening members each of which has a plurality of alternating flexible burrs and burr seating cavities. The burrs of one member interdigitate with the burr cavities of the other member when pressed together. The head of the burrs lock into the opposing head cavities securely holding the fastened devices from sideways movement and separation. Also, the members disengage using manual force.

8 Claims, 1 Drawing Sheet

FASTENING SYSTEM

BACKGROUND OF THE INVENTION

1. Field of the Invention

The present invention relates to fasteners. More particularly, the present invention relates to interlocking fasteners. Even more particularly the present invention relates to pressure type interlocking fasteners.

2. Description of the Prior Art

Interlocking fasteners generally comprise three types. One such type of interlocking fastener is commonly known as a "slide fastener". A slide fastener typically includes two joinable members each with alternating ridges and cavities. For example, in U.S. Pat. No. 2,878,541, there is disclosed a slide fastener which includes two members which are joined together by inserting the ridge of one member into the cavity of the other member. This type of interlocking fastener prevents the interlocking members from planar sliding. However, perpendicular movement of the interlocking members is not prevented.

A second type of interlocking fastener is commonly called a "zipper" fastener such as is disclosed in U.S. Pat. Nos. 1,776,847; 1,801,324 and 2,018,099. As is known to those skilled in the art to which the present invention pertains, a zipper has two interlocking members and a slide which forces the two members together. Planar and perpendicular movement of the interlocking members are prevented, but the members cannot be interlocked without the assistance of the slide.

The other or third common type of interlocking fastener, is a "pressure-type" device. This pressure-type device is commonly known as a "VELCRO"-type device or fastener, VELCRO fasteners, generally, comprise two nylon members that are joined together by pressure. One nylon member has multiple plastic hooks and the other member has multiple plastic loops. The hooks of the one member latch onto the multiple loops of plastic or fabric formed or provided on the second or opposed member. When the two members are joined by pressing them together their respective, planar movement is restricted and their perpendicular movement is restricted, until pulled apart. However, VELCRO-type devices are not designed to handle heavy loads or severe vibrations over long periods of time. Furthermore, they have a tendency to lose their holding capability and wear out over time, especially when put through multiple wash and rinse cycles.

Thus an interlocking fastener which joins its members by pressure, has a longer useful life and can support heavy loads is greatly desired. It would also be desirable if the apparatus can be unlocked without the aid of a slide or other type of tool and without destroying the members. The fastening system of the instant invention, as hereinafter described, achieves these purposes.

SUMMARY OF THE INVENTION

In accordance with the present invention there is provided an interlocking pressure-type fastening system. The fastening system hereof, generally, comprises:

a pair of opposed flexible members, each member comprising:

(1) a flexible strip;

(2) a plurality of spaced apart burrs disposed on the strip, each burr including:

(i) a head;

(ii) a foot disposed on the strip and extending therefrom; and (iii) a body having a top and a bottom, the body being medial to the head and a foot of the burr, the body having a neck proximate the top thereof, the outside surface of the body being tapered from the bottom to the neck and;

wherein the space between the adjacent burrs defines a seating cavity, corresponding to the shape of a burr, the cavity removably lockingly holding the burr from an opposed member when the burr is inserted into such cavity.

Each flexible strip, preferably, has a flat surface which enables two opposed members to be attached to devices which employ the fasteners hereof, such as, for example, bandages, articles of clothing i.e., shoes, shirts, sweatbands, etc., and the like.

The fastening system hereof is employed by pressing the burrs of one flexible member into associated cavities of the other flexible member. Once interlocked, the members are unable to move in either a planar direction or perpendicularly.

Application of sufficient manual force enables the members to be separated without the assistance of a removal device. The flexible strips are formed from plastic or other suitable material. The flexible burrs may be formed from the same or similar material used to form the strips or may be made from a different material. Likewise, the burrs may be hollow or solid.

Preferably, each strip and the burrs thereof are integrally formed as a unitary member.

The various features, advantages, or other used of the present invention will become more apparent by referring to the following detailed description and drawings. Throughout the following description and drawing, identical reference numbers are used to refer to the same component shown in multiple figures of the drawing.

DESCRIPTION OF THE PREFERRED EMBODIMENTS

Figure 1:
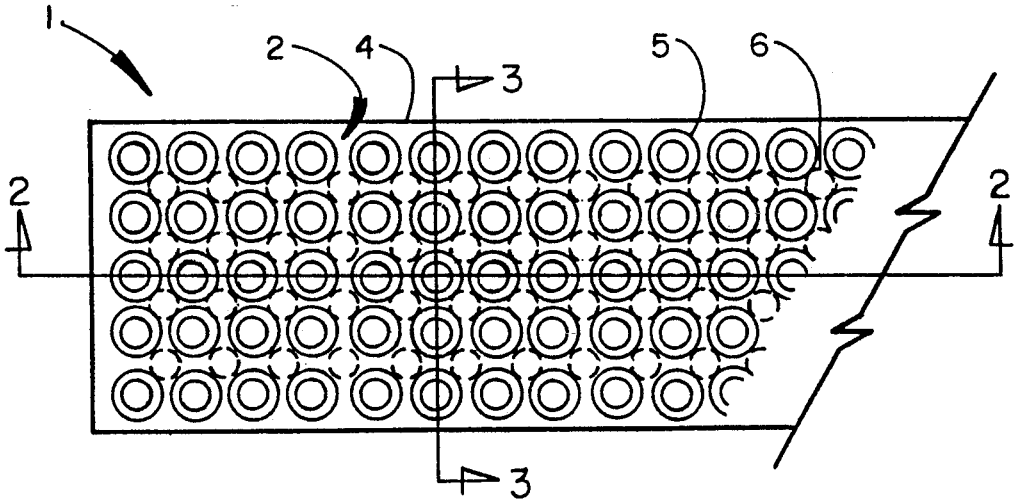
FIG. 1 is a plan view of the fastening system of the present invention in an engaged or locked position.

Referring now to the drawings there is shown the fastening system 1 of the instant invention. As shown, the fastening system 1 comprises, generally, a pair of opposed flexible members 2 and 3. Each flexible member 2, 3 comprises an associated flexible strip 4 and 4', respectively. Each flexible member 2, 3, also has a plurality of flexible burrs 5 and 5', respectively, disposed thereon. As shown, each flexible member 2, 3 has a plurality of burr seating recesses or cavities 6, 6' spaced between the burrs 5, 5' and corresponding in shape to an inverted burr 5 or 5'.

Each member 2, 3 may include means 10 for attaching the fastener system to an item (not shown) employing such system, such as, for example, articles of clothing, bandages etc.

Each flexible strip 4 and 4' is, preferably, formed from a flat plastic or fabric sheet of any required or desired shape or size. Each strip 4, 4' acts as a base 7, 7', respectively, for the plurality of burrs 5 and 5'. Each base 7 or 7' has a first surface 8 or 8' and a second surface 9 or 9'. Preferably, the burrs 5, 5' are integrally formed with the associated base surface 8 or 8'. The second or attaching surface 9, 9' enables the associated strip 4, 4' to be attached to the employing them.

As noted, the fastening system 1 may include means 10 for attaching such as an adhesive or the like which is used to secure the system 1 to the item. Likewise, the system can be sewn, heat welded or otherwise attached to the employing item. The manner by which the system is attached to the employing item is not critical hereto except to the extent that the system must be attached in such a fashion to permit interdigitation between the burrs.

Because each burr 5 or 5' is similarly constructed, therefore, for purposes of brevity only one such burr will be described. As shown, each flexible burr 5 which is, preferably, a unitary member, has a head 11, a body 12, and a foot 13. The head 11 of the burr 5 is geometrically shaped, such as a sphere 14 or the like. The head 11 is integrally formed with the body 12. The body 12 is, preferably, a conically formed stem 16 medially disposed between the head 11 and the foot 13.

The body 12 includes a top 17 and a bottom 18. A narrow neck 15 is provided proximate the stop 17 of the body 12 and is integral with the head 11. The bottom 18 of the body 12 is geometrically shaped, such as spherical, and is integral with the foot 13, as shown.

The body 12 tapers from the wider bottom 18 to the top 17 of the narrow neck 15. The bottom 18 narrows to integrate with the cylindrical foot 13. The foot 13, which, preferably, is cylindrical in shape, is integrally formed with the body 12 at one end and with the associated strip 4 at the other end.

As hereinafter described the tapering and widening of the burrs develop constrictions to enable the locking of a burr head in an associated cavity.

Each flexible burr 5 or 5' is, preferably, made of a solid, substantially rigid plastic or the like, and projects substantially perpendicular from its associated base 7 or 7'. Alternatively, the burrs 5 or 5' may be hollow substantially rigid members.

As shown, each burr seating cavity 6 or 6' is formed between adjacent burrs on the surface 8 or 8' of the associated base 7 or 7' of the associated strip 4, or 4'. Each cavity 6 or 6' is formed to correspond in shape to that of an associated burr 5 or 5' of the mating flexible member 2 or 3.

In use, each flexible member 2 and 3 is attached to an employing item via the attachment surface 9 or 9' by the means 10 for attaching or other suitable mode. After the flexible members 2 and 3 are secured to the item or items, the flexible members 2 and 3 are pressed together with the flexible burrs 5 of the first flexible member 2 engaging the burr seating cavities 6' of the second flexible member 3. The burrs 5' of the second flexible member 3 engage the burr seating cavities 6 of the first flexible member 2. As shown, a constriction is defined in any cavity therebetween adjacent burrs by the enlarged bottoms 18 of the bodies 12 of adjacent burrs 5. Thus, when a head 11 of the burr 5 of one member 2 is inserted into the associated retaining portion or chamber 19 or cavity 6 for the head 11, the head 11 becomes removably lockingly received therein.

Figure 3:
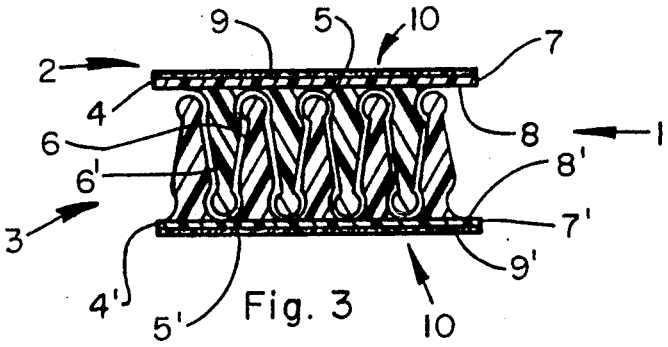
FIG. 3 is an end, cross-sectional view showing the fastening system of the instant invention in an engaged or locked position.
Figure 2:
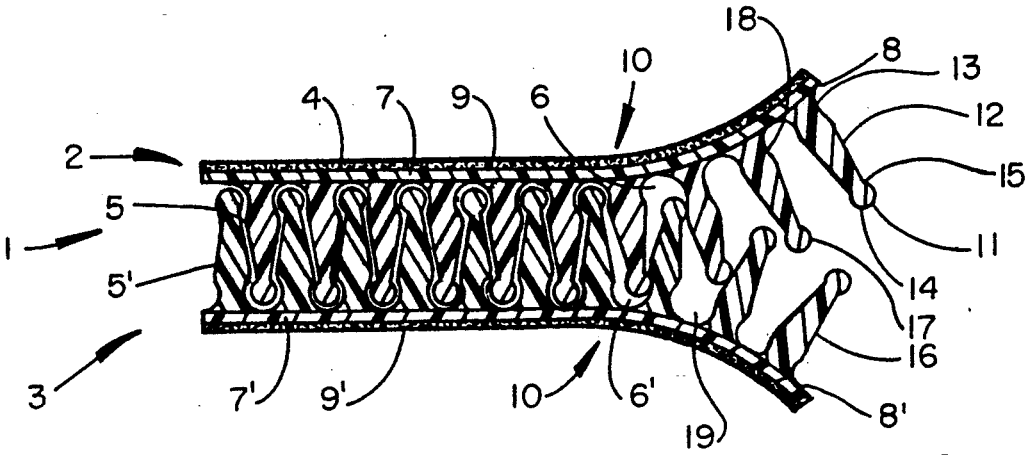
FIG. 2 is a side, cross-sectional view of the instant invention showing a portion of the burrs interlocked and a portion disengages.

Also, and as shown in FIGS. 2 and 3, the body 12 by virtue of its taper, becomes trapped in its cavity. In other words, the enlarged bottom 18 of one burr 5 abuts against an adjacent head 11 of an opposed member 3 to prevent inadvertent slippage of the burr therepast. This is due to the concavity of the retaining chamber 19 surrounding the head by virtue of the geometry accorded the members.

In essence, the burrs and cavities interdigitate and lock. When engaged, the members 2 and 3 remain firmly in position and restrained against both planar and vertical movement. When the members need to be separated, one flexible member is pulled away, in a lateral motion, from the other flexible member without the aid of a tool.

As noted hereinabove, the present fastening system 1 may be formed from a durable heat resistant plastic, such as polyethylene, polypropylene, a suitable filled or unfilled resin, or the like or any suitable fabric or material and the like. Furthermore, and as noted, preferably, the burrs 5 and 5' are, preferably, formed as solid members. The burrs 5, 5', being formed from a durable material, have an extended memory life. Also, the durable material withstands the wear and tear of constant use and laundering.

Some burrs 5 and 5' can be formed as solid or hollow members, which are substantially rigid. However, the burrs must have some flexibility to enable them to be inserted and withdrawn from their associated cavities, and to withstand any compressive forces applied thereto. Likewise, the burrs may be made from material different from that of the flexible strips. Preferably, though, each member is formed as a unitary member.

The present system can be made by any suitable mode, such as by molding vacuum forming or the like.

Having, thus, described the invention, what is claimed is:

1. A fastening system comprising:

a pair of opposed members, each member comprising:

(1) a flexible strip;

(2) a plurality of spaced apart burrs disposed on the strip, each burr including:

(i) a smooth spherical head having an outer surface, the surface of the head being continuous;

(ii) a foot disposed on the strip and extending therefrom; and (iii) a body having a top and a bottom, the body being medial to the head and the foot of the burr, the body having a neck proximate the top thereof, the body being tapered from the bottom to the neck, and wherein the space between adjacent burrs defines a seating cavity, corresponding to the shape of the burr, the cavity removably lockingly holding the head of the burr from an opposed member when such burr is inserted into such cavity, the inserted burr being normally held fast from movement in any direction.

2. The fastening system of claim 1, wherein the flexible strip and the burrs define a unitary member.

3. The fastening system of claim 1, wherein the flexible strip is plastic.

4. The fastening system of claim 1, wherein the burrs are solid members having sufficient flexibility to enable insertion and withdrawal from an associated cavity.

5. The fastening system of claim 4, wherein the flexible burrs are a plastic material.

6. The fastening system of claim 1, wherein the flexible strip comprises:

(a) a first surface for attaching the system to an item, and (b) an opposite surface, the burrs being disposed on the opposite surface.

7. The fastening system of claim 1, further comprising:

means for attaching each flexible member to an item employing the system.

8. The fastening system of claim 7, wherein the means for attaching the flexible strip comprises an adhesive.

* * * * *